US005316387A

United States Patent [19]

Polett et al.

[11] Patent Number: 5,316,387

[45] Date of Patent: May 31, 1994

[54] STRUCTURALLY-ENHANCED FLEXIBLE BULK CONTAINER

[76] Inventors: Walter J. Polett; Muriel S. Polett, both of P.O. Box 55, Mount Holly, N.J. 08060

[21] Appl. No.: 6,275

[22] Filed: Jan. 15, 1993

[51] Int. Cl.[5] ..... B65D 30/10

[52] U.S. Cl. ..... 383/119; 383/67

[58] Field of Search ..... 383/17, 19, 38, 41, 383/67, 119; 220/652, 653

[56] References Cited

U.S. PATENT DOCUMENTS

| | | | |
|---|---|---|---|
| 3,949,901 | 4/1976 | Tokita | 383/38 X |
| 5,073,035 | 12/1991 | Williams | 383/17 X |
| 5,203,633 | 4/1993 | Derby | 383/17 |

FOREIGN PATENT DOCUMENTS

| | | | |
|---|---|---|---|
| 4044958 | 2/1992 | Japan | 383/38 |
| 1544625 | 4/1979 | United Kingdom | 383/38 |

*Primary Examiner*—Allan N. Shoap
*Assistant Examiner*—Jes F. Pascua
*Attorney, Agent, or Firm*—Norman E. Lehrer

[57] ABSTRACT

A flexible bulk container for the handling and storage of flowable materials having structural maintenance means attached to the inside surfaces of the container for providing structural support to the walls which comprise the container. The container is comprised of a plurality of walls attached together and defining an enclosure having a bottom and a top panel attached to the encircling enclosure. Several embodiments of the structural maintenance means are enclosed, the first one comprising a loops and rope combination attached to the inner surfaces of the flexible container. Loops are attached to each side of the flexible container on the inside surface at a plurality of levels. A rope is threaded through the loops on each level and its ends are attached. The rope is drawn through and adjusted in size so that it holds the container walls in a substantially vertical orientation. A second embodiment includes the use of panels arranged in a crossing formation and attached to the inside surfaces of the container walls. The third embodiment includes the use of flaps attached to each inside surface of each wall which extend from the walls toward the center of the flexible container. Each flap has a plurality of holes formed through the edge of the flap located toward the center of the container. A continuous rope is threaded through the holes in the flaps at each level and attached at its ends. A plurality of levels of the hole and rope combination are arranged on the flaps for providing the needed support to the container sides. For each embodiment, the container is filled with flowable materials and the structural maintenance means functions to provide an opposing force against the tendency of the flowable materials to push outwardly on the container, thereby maintaining the cubicle shape of the flexible container.

6 Claims, 2 Drawing Sheets

STRUCTURALLY-ENHANCED FLEXIBLE BULK CONTAINER

BACKGROUND OF THE INVENTION

This invention relates to flexible bulk containers used for the handling and storage of flowable materials. More particularly, the invention is directed toward a container having means affixed therein for maintaining the shape and structural integrity of the container while it is partially or completely filled with flowable materials.

Flexible bulk containers carrying flowable materials are generally transported by the truck load wherein stacks of the flexible containers are placed into the truck. As with any material transport, it is important from an efficiency standpoint to stack and load the flexible containers in an ordered manner. Generally, flexible containers are designed to take on a cubicle shape when completely full. However, because of the flexible material from which the walls of the container are made, the containers tend to bulge when filled with the flowable materials. Accordingly, the containers take on a shape representative of a cube but having rounded edges and protruding sides. Because of the container's tendency to take on this shape, the containers become unaccommodating to efficient loading. Accordingly, valuable transportation space can be lost.

It is, therefore, desirable to maintain the containers in a predictable and primarily cubicle shape. As such, the cubicle containers save space and allow more material and containers to be transported in a single load. The structural integrity of the flexible containers can be maintained in numerous ways, many of which are inconvenient to the handling of the containers. Supports located on the outer skin of the containers and containers made out of a material which is less flexible can be used. However, these methods are not compatible with the advantages of a purely flexible container such as the flexible container's light weight and easy storage when they are not being used. In the prior art, flexible containers using inner structural support means are disclosed.

U.S. Pat. No. 5,076,710 to Derby for example discloses a flexible container having inner support members (FIG. 11) in which the members assist in maintaining the cubicle structure of the container. Similarly, the Derby patent also discloses a prior art container in FIG. 10 having inner bridge members for maintaining the structure of a more cylindrically-shaped container. The Derby patent uses bridge panels which span each corner of the container on the interior surface. The panels assist in maintaining the cubicle structure of the container. However, because the panels are located so close to each corner of the container, the container tends to have smaller areas where the flowable materials may have a tendency to become lodged. Also, because the panels are not attached in any manner to each other, the Derby invention requires substantially more work in attaching the panels to the interior surface of the flexible container.

SUMMARY OF THE INVENTION

The invention in the present application is a flexible container having structural maintenance means for maintaining the structural integrity of the flexible container while it is filled. The invention causes the container to maintain a cubicle shape and, therefore, allows for more efficient and easier transport.

In accordance with the invention, the flexible bulk container includes a plurality of walls being attached together and defining an encircling enclosure and a bottom panel being attached to the plurality of walls defining the enclosure. The invention comprises structural maintenance means attached to each wall on the inside surface of the walls and extending therefrom. The structural maintenance means extend from the inside walls and are connected with another of the structural maintenance means extending from another wall.

In a first embodiment of the invention, a plurality of loops are attached to the inside surfaces of the walls at a plurality of levels. Each level includes a loop attached preferably to each wall of the flexible container wherein each loop within a level is located at an equal distance from the bottom panel. An elongated and continuous rope or the like passes through each loop at each level. The rope is joined at its ends and provides a resistive force to the tendency of the flowable materials located in the container to push outwardly, thereby assisting in maintaining the cubicle shape of the container.

A second embodiment of the structural maintenance means comprises panels having one edge affixed to the inside surface of each wall and extending toward the center of the flexible container. The panels are then attached at a second edge to another panel similarly extending into the center of the flexible container. The panels similarly apply a resistive force to the flowable material's tendency to push the container outwardly.

A third embodiment comprises the use of a plurality of flaps having a first edge attached to the inside surface of the walls of the flexible container and a second edge extending toward the center of the flexible container. Adjacent to the second edge and on each flap, holes are formed therein at equal distances from the bottom panel. A continuous rope, or the like is threaded through the holes and connected at its ends for providing a resistive force against the flowable material's tendency to push the container outwardly when the container is filled.

The instant invention has all of the advantages of the prior art containers in maintaining the container in a cubicle shape. However, in addition, the instant invention inherently forms larger sections within the interior of the flexible container, thereby allowing for more efficient and easier flow of the flowable materials from the container upon emptying of the same.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
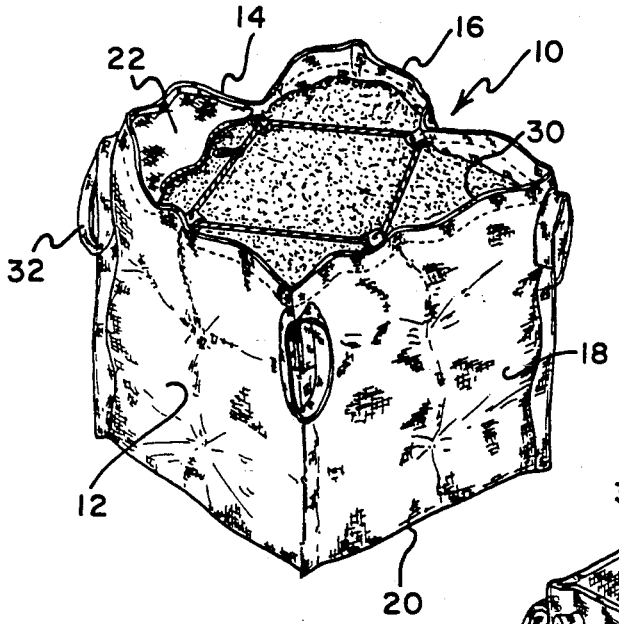
FIG. 1 is a perspective view of the flexible container showing the container filled and incorporating the first embodiment of the present invention using a continuous rope and a plurality of levels of loops attached to the walls.

Referring now to the drawings in detail wherein like reference numerals have been used throughout the various figures to designate like elements, there is shown in FIG. 1 a perspective view of a flexible container constructed in accordance with the principles of the first embodiment of the present invention and designated generally as 10. FIG. 1 shows the flexible container filled with flowable material, each embodiment to be discussed herein can be similarly filled, although not shown that way.

The flexible container for each embodiment is comprised of the side walls 12, 14, 16 and 18, a bottom panel 20 and a top panel 22 (shown only in FIG. 1). Each side wall 12, 14, 16 and 18 has an inside surface 24, 26, 28 and 30, respectively. Also, the flexible container may have a lifting loop 32 at each corner of the container. Additionally, the container may have a fill-spout located in and connected to the top panel and a discharge spout located in and connected to the bottom panel, neither of which is shown as they are well known in the field.

Figure 2:
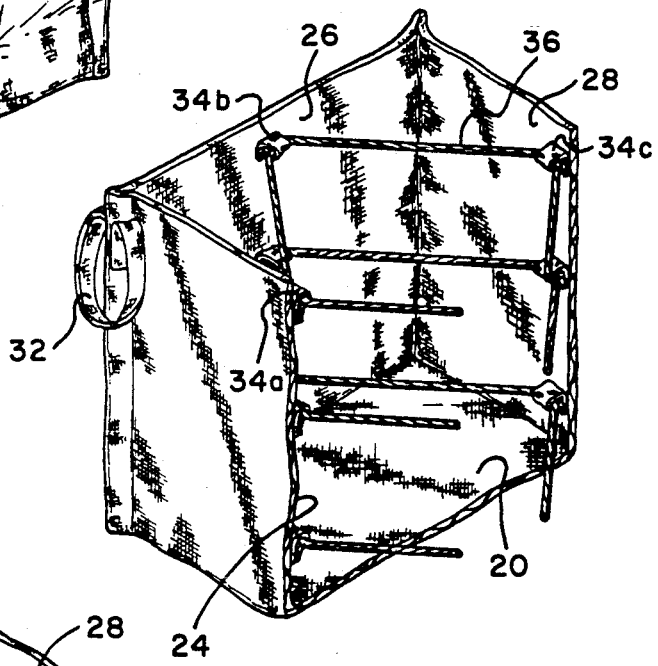
FIG. 2 is a cut-away perspective view showing the unfilled interior of the container embodiment shown in FIG. 1.

Referring now to FIG. 2, the first embodiment of the invention comprises loops 34*a*, 34*b*, 34*c* and 34*d* (not shown) attached to the inside surfaces 24, 26, 28 and 30, respectively. The loops 34*a–d* are attached to substantially the mid-point of each inside surface 24, 26, 28 and 30. A continuous rope 36 is drawn through the loops 34*a–d* and attached at its ends. As shown in FIG. 2, a plurality of levels of the loop and rope combination is used for providing structural support to the container over its entire height. In the preferred embodiment, three levels of loops and rope combinations are used. However, depending on the size of the container, it may be desirable to use a greater number of levels of loops and rope combinations or fewer such combinations.

Upon filling of the container, the flowable materials tend to push the container walls outwardly, thereby threatening the maintenance of the desired cubicle shape of the flexible container. However, the loops and rope combination provide an opposing force to the outward pushing flowable materials, thereby helping to maintain the structural integrity of the container.

Figure 3:
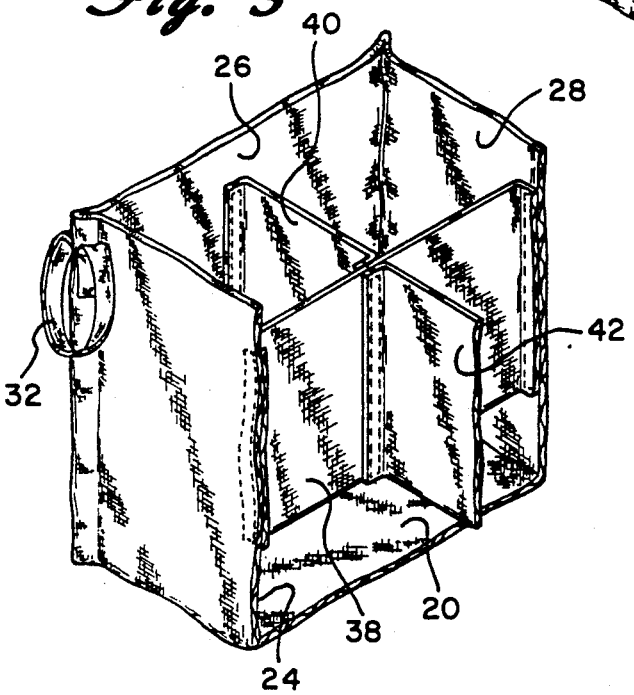
FIG. 3 is a perspective cut-away view showing a second embodiment of the invention using panels attached to the interior surface of the container.

Referring now to FIG. 3, the second embodiment of the invention includes the use of panels attached to the inside surfaces 24, 26, 28 and 30 (not shown in FIG. 3). The panels 38, 40 and 42 are attached to the sides 24 and 28, 26, and 30, respectively, causing the interior of the bag to be divided into four sections. As shown in FIG. 3, the panels are attached by sewing the same to the inside surfaces of the walls. The panels are positioned substantially at the horizontal and vertical center of each wall so that they provide the resistive forces at that location when the container is full. The panels may range in height, preferably, from one-half to two-thirds of the height of the container such that flowable materials are able to flow underneath and above the panel attachments from one section to another section and still maintain the desired structure. As a result, the flowable materials will not become lodged or caught within any one section and are easily removable from the flexible container.

The panel 38 extends the full inside width of the flexible container 10 being connected to the inside surface 24 and extending to the inside surface 28 and being connected there also. The panel 40 extends from the inside surface 26 to the panel 38 and is attached or sewn thereto. Similarly, the panel 42 extends from the inside surface 30 to the panel 38 and is similarly attached or sewn to the same. As such, upon filing the container with the flowable materials, the panels, similar to the loop and rope combination, resist the tendency of the flowable materials to push the sides outward by applying a resistive inward force to the sidewalls. Accordingly, the cubicle structure of the flexible container is maintained.

Figure 4:
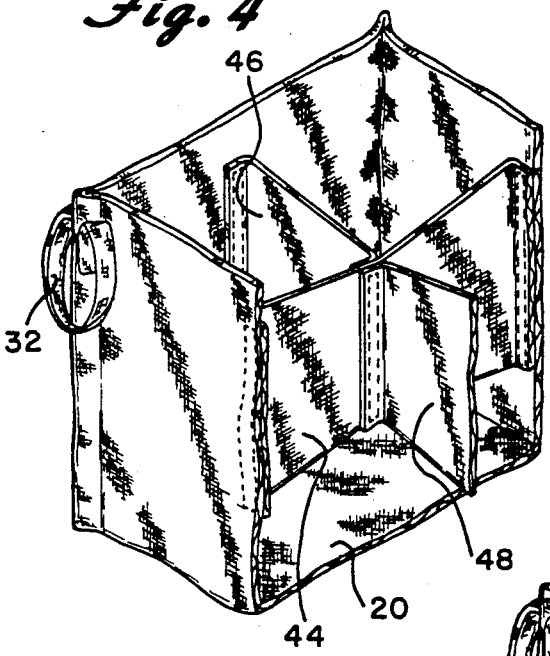
FIG. 4 is a modification of the FIG. 3 container showing the panels tapered from their connection at the inside surfaces of the flexible container toward the center of the container.

A modification of the embodiment shown in FIG. 3 is illustrated in FIG. 4 where the panels 44, 46 and 48 are tapered. The panels are tapered in a manner such that the height of each panel at the point of connection to the side walls 24 and 28, 26 and 30, respectively, is greater than the height of the panels at their connecting point at the center of the flexible container. As such, the panels provide substantially the same structural maintenance function yet allow for greater flowability of the flowable materials above and below the panels and between the sections inherently formed from the use of the panels. The use of tapered panels as shown in FIG. 4 may be desirable for smaller sized containers where the flowability of the flowable materials becomes more restricted by the smaller sections formed from the panels and a smaller volume bag.

Figure 5:
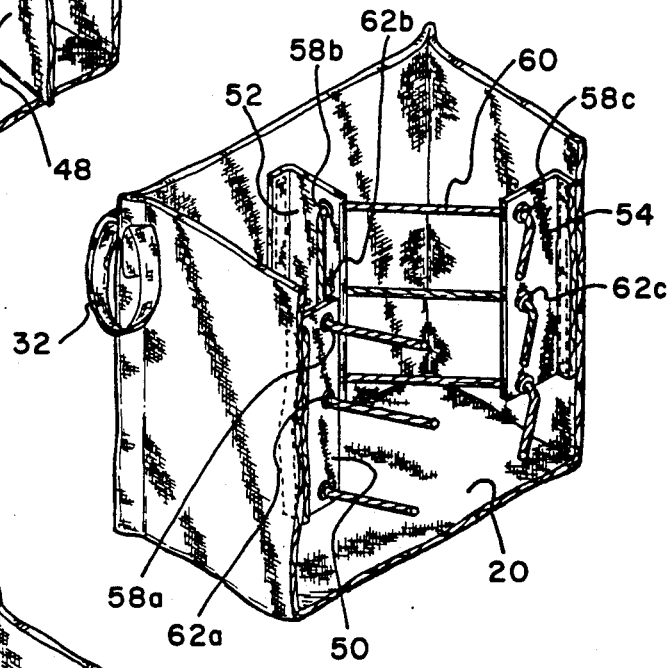
FIG. 5 is a perspective cut-away view showing a third embodiment of the invention using flaps extending from the inside surface of the walls wherein the flaps have holes therethrough at a plurality of levels and continuous rope running through the holes.

Referring now to FIG. 5, the third embodiment of the invention comprises the use of flaps 50, 52, 54 and a similar fourth flap 56 (not shown) attached to the inside surfaces 24, 26, 28 and 30, respectively. The flaps 50, 52, 54, and 56 are sewn to their respective inside surfaces of the walls and extend inwardly therefrom toward the center of the flexible container 10. The edges of the flaps located nearest the center of the flexible container have grommeted holes 58*a*, 58*b*, 58*c* and 58*d* (not shown) formed therein. A continuous rope 60 is threaded through the holes and has its ends connected together. As shown in FIG. 5, the hole arrangement is repeated on the flaps at a plurality of levels. For example, holes 62*a*, 62*b*, 62*c* and 62*d* (not shown) are similarly formed through the flaps beneath the first set of holes 58*a–d*. At each level, the holes are located at an equal distance from the bottom panel 20. A third level of holes is formed in the present embodiment through the flaps beneath the holes 62*a–d*. Ropes similar to rope 60 are threaded through each additional level of holes. Depending on the size of the flexible container 10 and the amount of flowable material to be transported, a different number of levels of the holes and rope combination can be used to further maintain the structural integrity of the flexible container.

Figure 6:
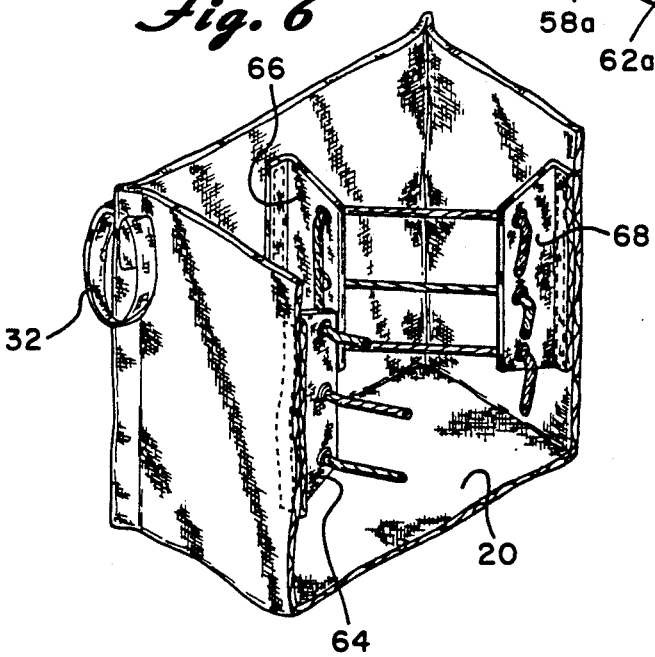
FIG. 6 is a perspective cut-away view of the FIG. 5 embodiment showing the flaps being tapered from their connection at the inside wall to the center of the flexible container.

In FIG. 6, there is shown a modification of the flap embodiment shown in FIG. 5. As can be seen therein, flaps 64, 66, 68 and 70 (not shown) are similarly attached to sides 24, 26, 28 and 30, respectively, as the flaps are in FIG. 5. However, the flaps in FIG. 6 are tapered such that the height of each flap at its point of attachment to the side walls is greater than the height of the flap as it extends toward the center of the flexible container. Similar to the tapered embodiment in FIG. 4, the flaps provide substantially the same structural support while taking up less room.

The several embodiments of the present invention are used by simply attaching each embodiment to the respective inside surfaces of the flexible container 10. This is, of course, preferably done when the bag is manufactured. For example, as the bag is being manufactured, the loops 34*a–d* are attached. Prior to use, the rope is drawn through the loops and its ends are connected such that the rope is somewhat taut. As such, the rope will not allow the container to project outwardly at its sides, thereby maintaining the cubicle structure. Similarly, the flap embodiment is used by attaching the flaps to the sides when the bag is manufactured and threading the ropes through the holes in the flaps prior to use of the bag. Again, the ropes are drawn through and connected at their ends such that they are taut and will not allow the walls of the containers to project outward upon filling the container with the flowable materials.

In the FIG. 3 and FIG. 4 embodiments of the invention, the panels are preferably attached together in the crossing pattern (shown in FIG. 3) prior to their installation into the container. It is preferable to sew the panels together for their attachment. The panel configuration is then placed into the container and the respective panels are sewn to the respective sides at the midpoints of each sidewall.

For each embodiment, the flowable material is then added to the container through the fill spout, and each embodiment will function to alleviate the tendency of the container to project outward and deform the desired cubicle structure. Upon full filling of the container with the flowable materials, each embodiment will cause the flexible container to remain as a cube, thereby allowing it to be stacked and transported in the most efficient manner.

The present invention may be embodied in other specific forms without departing from the spirit or essential attributes thereof. By way of example and not limitation, in lieu of the grommeted holes in the flaps of FIGS. 5 and 6, loops similar to those shown at 34*a–d* in FIG. 2 can be sewn or otherwise attached to the innermost edges of the flaps. Accordingly reference should be made to the appended claims rather than to the foregoing specification as indicating the scope of the invention.

What is claimed is:

1. A flexible bulk container for the handling and storage of flowable materials, comprising:

a plurality of flexible walls connected together and defining an encircling enclosure and a bottom panel attached to a lower end of said encircling enclosure forming said flexible bulk container;

each of said walls having an inside surface defining an enclosed area;

structural maintenance means comprising components attached to said walls on said inside surfaces for providing structural support to said walls, said components of said structural maintenance means extending from said inside surfaces of said walls and being connected with another of said components of said structural maintenance means extending from another of said walls, said structural maintenance means being comprised of a plurality of flaps, each of said flaps having a first edge and a second edge, said first edge of each flap being attached to the inside surface of a different one of said walls, each of said flaps extending toward the center of said enclosure and having a plurality of holes formed thereon adjacent the second edge at a plurality of levels, the second edge of each of said flaps being spaced apart from each of the other second edges, said structural maintenance means further including an elongated joining means extending through said holes at each level for joining the flaps and assisting in maintaining the structure of the container.

2. The invention according to claim 1 wherein said joining means is a rope.

3. The invention according to claim 1 wherein said flaps are tapered from said first edge toward said second edge.

4. The invention according to claim 1 wherein said container further comprises a top panel attached to an upper end of said walls, said top panel having a fill spout attached thereto.

5. The invention according to claim 1 wherein said bottom panel has a discharge spout attached thereto.

6. The invention according to claim 1 wherein said flaps extend substantially perpendicular from said inside surfaces of said walls.

* * * * *